US010045637B2

(12) United States Patent
Akins

(10) Patent No.: US 10,045,637 B2
(45) Date of Patent: Aug. 14, 2018

(54) PRODUCT DISPLAY UNIT

(71) Applicant: Display Technologies, LLC, Lake Success, NY (US)

(72) Inventor: Miles Craig Akins, Williamsburg, VA (US)

(73) Assignee: Display Technologies LLC, Lake Success, NY (US)

( * ) Notice: Subject to any disclaimer, the term of this patent is extended or adjusted under 35 U.S.C. 154(b) by 0 days.

(21) Appl. No.: 15/218,170

(22) Filed: Jul. 25, 2016

(65) Prior Publication Data

US 2017/0020303 A1 Jan. 26, 2017

Related U.S. Application Data

(60) Provisional application No. 62/196,398, filed on Jul. 24, 2015.

(51) Int. Cl.
*A47F 1/12* (2006.01)
*A47F 7/28* (2006.01)

(52) U.S. Cl.
CPC ..... *A47F 1/125* (2013.01); *A47F 1/126* (2013.01); *A47F 7/28* (2013.01)

(58) Field of Classification Search
CPC ..... A47F 1/125; A47F 1/126; A47F 5/0025; A47F 5/005; A47F 7/28; A47F 1/12; A47F 3/0486; B65G 11/143; F25D 25/00; F25D 25/02
USPC ..... 211/59.2
See application file for complete search history.

(56) References Cited

U.S. PATENT DOCUMENTS 2,029,109 A * 1/1936 Kucher ..... F25D 25/00 211/74
2,668,648 A * 2/1954 Carlsen ..... B65B 67/04 193/21
2,678,735 A * 5/1954 Crcedon ..... F25D 25/00 211/151
3,404,927 A * 10/1968 Mellion ..... A47F 1/08 211/59.2
3,501,016 A * 3/1970 Eaton ..... A47F 7/28 211/49.1
4,134,520 A * 1/1979 Collins ..... G07F 11/38 221/129
5,595,310 A * 1/1997 Spamer ..... A47F 1/12 211/59.2
5,819,937 A * 10/1998 Walker ..... A47B 73/00 206/203
6,354,098 B1 * 3/2002 Bardin ..... A47F 1/12 221/124
6,450,349 B2 * 9/2002 Lee ..... B65G 11/143 211/175

(Continued)

*Primary Examiner* — Ko Hung Chan
(74) *Attorney, Agent, or Firm* — Andrus Intellectual Property Law, LLP

(57) ABSTRACT

A product display unit includes a first track and a second track. The first track defines a longitudinal axis and is configured to support products thereon. The first track is configured to guide the products along the longitudinal axis. The second track is configured to support products thereon. A first portion of the second track is configured to guide the products in a first direction that is disposed at an angle with respect to the longitudinal axis. A second portion of the second track is configured to guide the products in a second direction that is parallel to the longitudinal axis.

14 Claims, 7 Drawing Sheets

(56) References Cited

U.S. PATENT DOCUMENTS

| | | | | |
|---|---|---|---|---|
| 6,502,408 | B1 * | 1/2003 | Corcoran | F25D 25/00 193/35 R |
| 7,448,504 | B2 * | 11/2008 | Primiano | A47F 1/12 108/107 |
| 7,823,733 | B2 * | 11/2010 | Futori | A47F 1/087 211/49.1 |
| 9,427,096 | B2 * | 8/2016 | Subu | A47F 3/0486 |
| 9,576,419 | B2 * | 2/2017 | Carpentier | A47F 3/0491 |
| 2014/0151313 | A1 * | 6/2014 | Breslow | A47F 1/04 211/59.3 |

* cited by examiner

PRODUCT DISPLAY UNIT

CROSS-REFERENCE TO RELATED APPLICATION

The present application claims priority to, and the benefit of, U.S. Provisional Patent Application Ser. No. 62/196,398 filed on Jul. 24, 2015, the entire contents of which being herein incorporated by reference in its entirety.

BACKGROUND

The present disclosure relates to a product display unit, and more particularly, to a product display unit having at least one row or track for supporting more products than a different row or track of the product display unit.

Various types of product display units and merchandisers are commonly used in retail environments to display different types of products. As opposed to simply positioning products on shelves, product display units are commonly used to position products on a shelf in manner which automatically advances (e.g., via gravity or a pusher) a trailing or distal product (i.e., a product that is behind a lead or proximal-most product) closer to a consumer once the lead product has been removed from the shelf As can be appreciated, such product display units facilitate the arrangement and upkeep of products, as the trailing products do not have to be manually moved toward the front of the shelf, for instance.

Additionally, in retail environments, for example, floor space, shelf space, and space in cold vaults is limited, and retailers typically attempt to maximize the amount of products they can store/display in their retail space. Further, retailers and other users of product display units often use products display units of different sizes to fit on a variety of types and sizes of shelves and cabinets, for example. Additionally, certain products are sold more often than other products, which may result in one row or track of products emptying prior to other rows or tracks of products and/or a need to restock certain products more often than other products.

Accordingly, it may be desirable for a product display unit to include at least one row or track with a larger capacity than a different row or track, such that more products that are high-selling products can be supported in a single row or track of the product display unit, for example.

SUMMARY

The present disclosure relates to a product display unit including a first track and a second track. The first track defines a longitudinal axis and is configured to support products thereon. The first track is configured to guide the products along the longitudinal axis. The second track is configured to support products thereon. A first portion of the second track is configured to guide the products in a first direction that is disposed at an angle with respect to the longitudinal axis. A second portion of the second track is configured to guide the products in a second direction that is parallel to the longitudinal axis.

In disclosed embodiments, the first direction may be perpendicular to the longitudinal axis.

It is further disclosed that the first portion of the second track may be disposed at a distal portion of the second track.

In disclosed embodiments, at least part of the first portion of the second track may be disposed distally of a distal-most portion of the first track.

In embodiments of the disclosure, an entirety of a length of the first track may be disposed along the longitudinal axis.

It is further disclosed that the product display unit may include a pusher disposed in mechanical cooperation with the first portion of the second track. The first track may be disposed at an incline to facilitate gravity feed of at least one product positioned thereon.

In disclosed embodiments, the product display unit may include a first sidewall and a second sidewall defining the second track therebetween. The first sidewall may include a first linear portion and a second linear portion. The first linear portion may disposed at an angle (e.g., perpendicular) with respect to the second linear portion. The first sidewall may include a first curved section interconnecting the first linear portion and the second linear portion. The second sidewall may include a third linear portion, a fourth linear portion, and a second curved section interconnecting the first third portion and the fourth linear portion.

It is also disclosed that the first track and the second track may be within a single plane.

The present disclosure also relates to a method of displaying products. The method includes positioning a first plurality of products on a first track such that each product of the first plurality of products is movable along a longitudinal axis, and positioning a second plurality of products in a second track such that at least one product of the second plurality of products is movable in a first direction that is disposed at an angle to the longitudinal axis and is movable in a second direction that is parallel to the longitudinal axis.

In disclosed embodiments, the method may include moving the at least one product of the second plurality of products in the first direction along a first portion of the second track, and subsequently moving the least one product of the second plurality of products in the second direction along a second portion of the second track.

It is further disclosed that the method may include moving the at least one product of the second plurality of products along an arcuate path after moving the at least one product of the second plurality of products in the first direction along a first portion of the second track, and before moving the least one product of the second plurality of products in the second direction along a second portion of the second track.

It is also disclosed that the first direction is perpendicular to the second direction.

BRIEF DESCRIPTION OF THE DRAWINGS

Embodiments of the present disclosure are described hereinbelow with reference to the drawings wherein.

DETAILED DESCRIPTION

Figure 1:
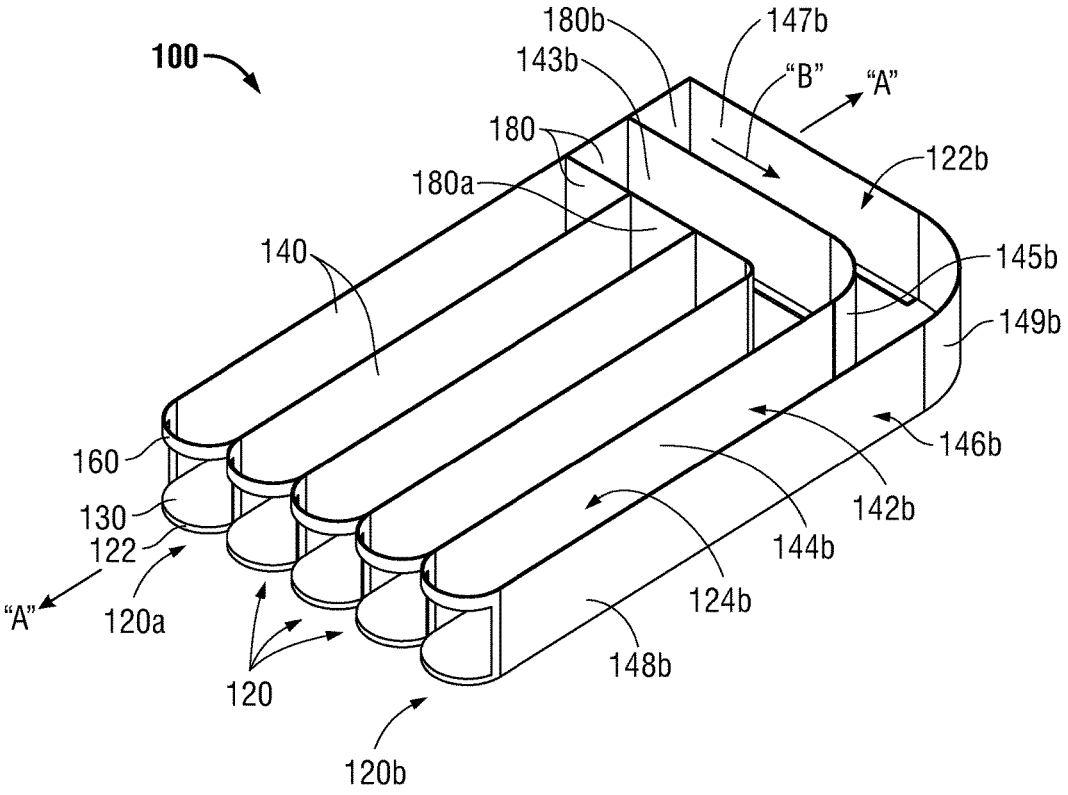
FIG. 1 is a perspective view of a product display unit including five tracks in accordance with an embodiment of the present disclosure.

Embodiments of the presently disclosed product display unit are now described in detail with reference to the drawings, in which like reference numerals designate identical or corresponding elements in each of the several views. As used herein the term "distal" refers to that portion of the product display unit, or component thereof, farther from a user (e.g., customer), while the term "proximal" refers to that portion of the product display unit, or component thereof, closer to the user.

Embodiments of a product display unit are illustrated in FIGS. 1-6 and are generally referenced by numeral 100. Product display unit 100 includes a plurality of adjacent product display tracks 120. In FIG. 1, each product display track 120 includes a base 122, a product-supporting surface 130, sidewalls 140, and a proximal member 160. Tracks 120 also include a distal member 180, and some tracks include a pusher 190 (FIGS. 2A-2C), as described in detail below.

The product-supporting surfaces 130 are configured to slidably support a plurality of products "P" thereon. That is, products "P" are slidable along the product-supporting surfaces 130.

The sidewalls 140 are disposed at both lateral sides of each track 120 and are configured to help guide and maintain products "P" on the product-supporting surface 130 of the track 120. When a plurality of tracks 120 is positioned adjacent one another, it is envisioned that adjacent tracks 120 share common sidewalls 140, or share portions of common sidewalls 140. Alternatively, track 120 may include a pair of sidewalls 140 such that adjacent tracks 120 include sidewalls 140 in an abutting relationship.

The proximal member 160 is positioned adjacent the front or proximal portion of each track 120 and is configured to help maintain products "P" on the track 120. More specifically, the proximal member 160 helps prevent a proximal-most product "PP" from falling proximally off of the track 120. Additionally, the proximal member 160 opposes the gravitational force and/or the force supplied by pusher 190. Further, while the illustrated embodiments include a certain type of proximal member 160, the present disclosure includes the use of any suitable type and number of proximal members 160 per track 120.

Product display unit 100 generally includes two types of tracks 120—a first track 120*a* and a second track 120*b*. The first track 120*a*, which defines a longitudinal axis "A-A" is linear along its entire length and thus guides products "P" thereon generally linearly in the direction of the longitudinal axis "A-A." Here, gravity may urge products "P" to slide along the first track 120*a* in a distal-to-proximal direction. In such gravity feed arrangements, a distal portion of the track 120 is typically elevated with respect to a proximal portion of the track, such that gravity urges the products "P" toward proximal member 160. Additionally, a pusher 190 may also be used in connection with the first track 120*a*.

The second track 120*b* includes a first, distal portion 122*b*, and a second, proximal portion 124*b*. Distal portion 122*b* extends at an angle (e.g., perpendicularly) with respect to the longitudinal axis "A-A", and proximal portion 124*b* extends in a parallel direction with respect to the longitudinal axis "A-A." In the illustrated orientations, the first, distal portion 122*b* of the second track 120*b* is disposed distally of a distal-most portion of the first track 120*a*.

Figure 2A:
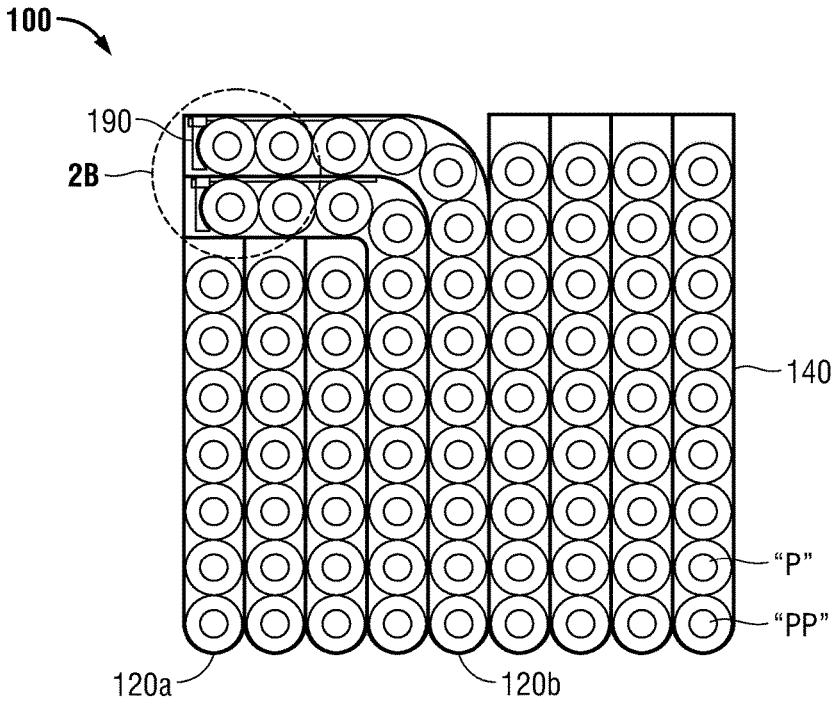
FIG. 2A is a top of the product display unit shown in FIG. 1 including an additional four tracks and shown with a plurality of products on the tracks.
Figure 2B:
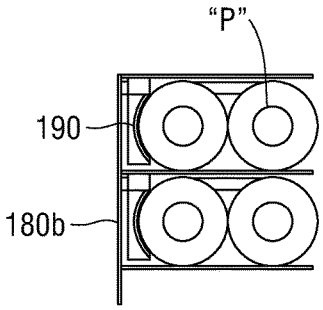
FIG. 2B is an enlarged view of the area of detail of the product display unit indicated in FIG. 2A.
Figure 2C:
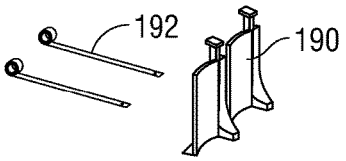
FIG. 2C is a perspective view of pushers and biasing elements usable with the product display unit of the present disclosure.
Figure 2D:
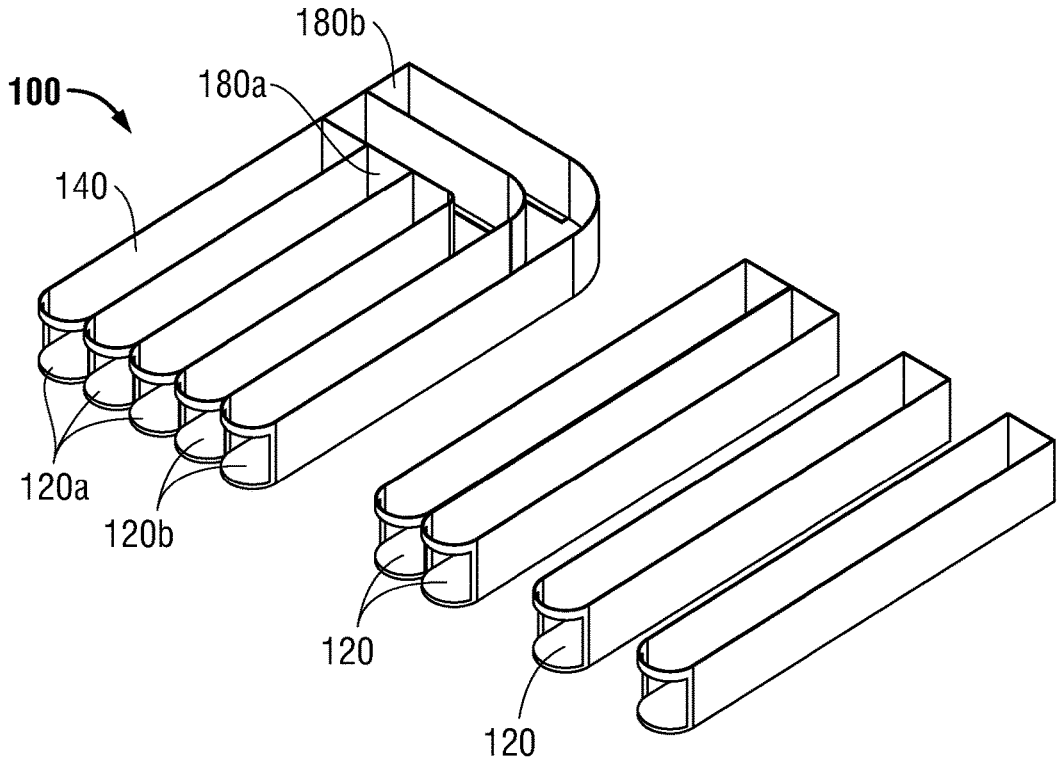
FIG. 2D is a perspective view of the product display unit shown in FIG. 1 including additional tracks.
Figure 3:
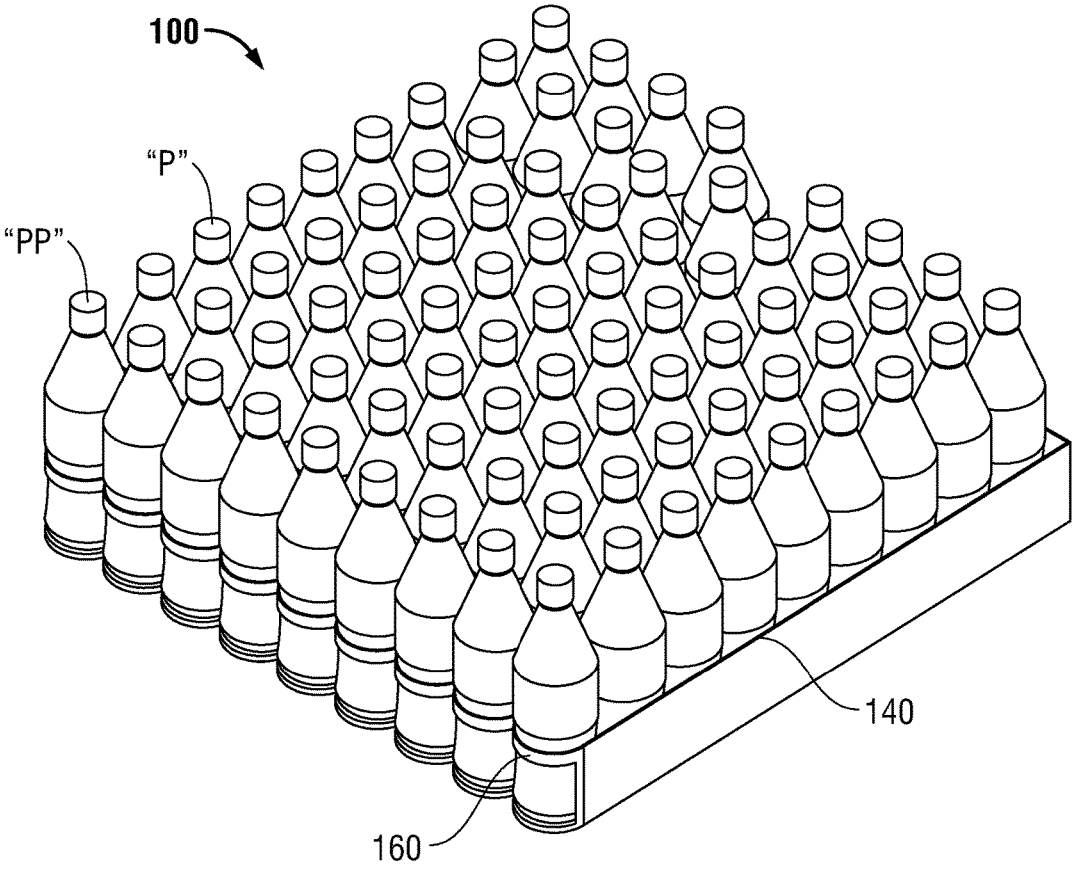
FIG. 3 is a perspective view of a product display unit of the present disclosure including nine tracks with a plurality of products on each track.
Figure 4:
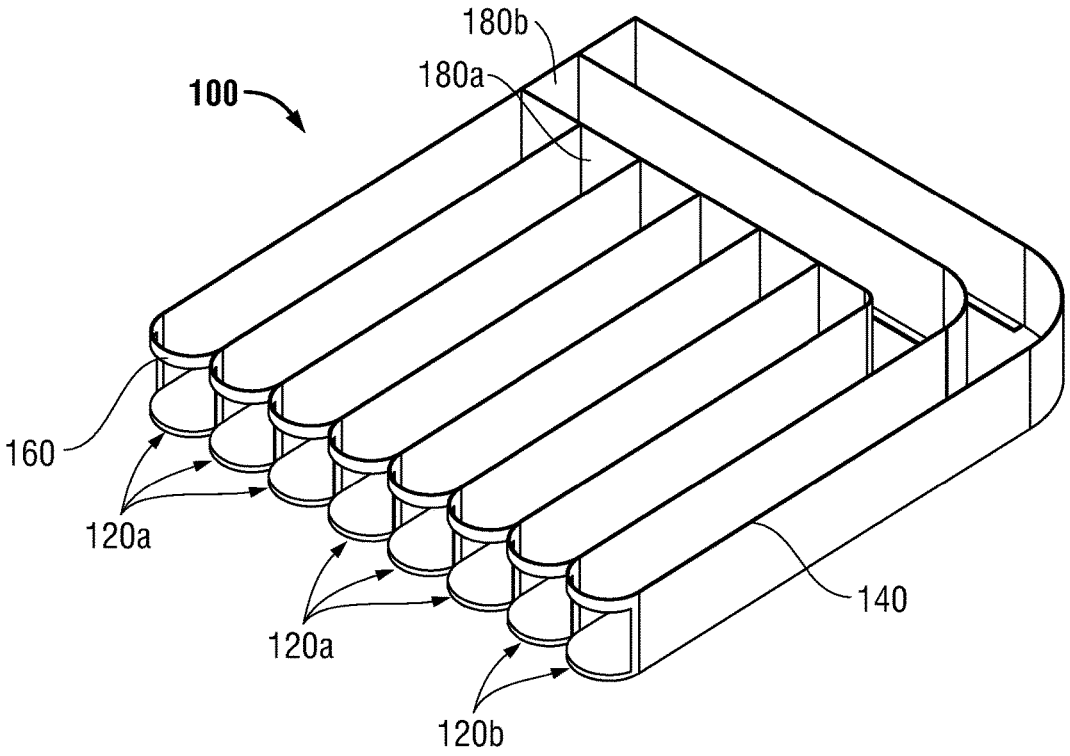
FIG. 4 is a perspective view of a product display unit including eight tracks in accordance with an embodiment of the present disclosure.
Figure 5A:
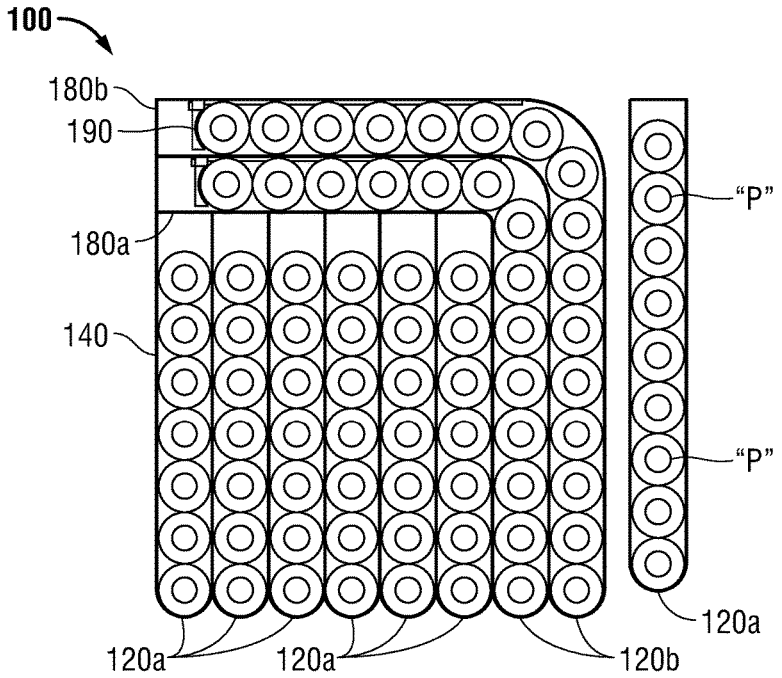
FIG. 5A is a top view of an embodiment of the product display unit including nine tracks and having a plurality of products on the tracks.
Figure 5B:
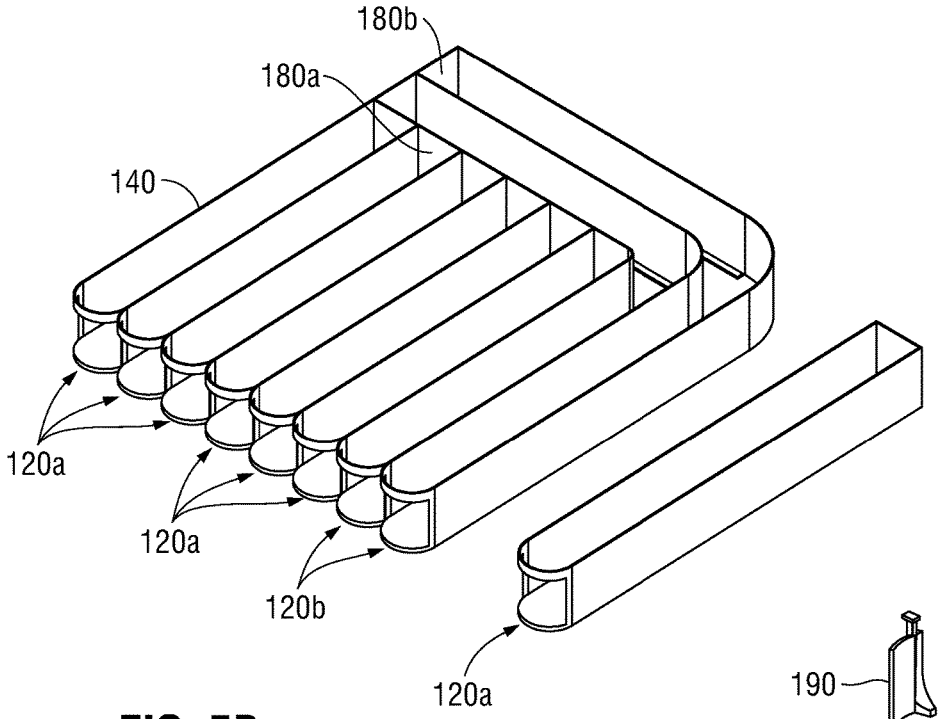
FIG. 5B is an assembly view of portions of the product display unit shown in FIG. 5A.
Figure 5C:
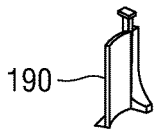
FIG. 5C is a perspective view of a pusher for use with product display units of the present disclosure.
Figure 6:
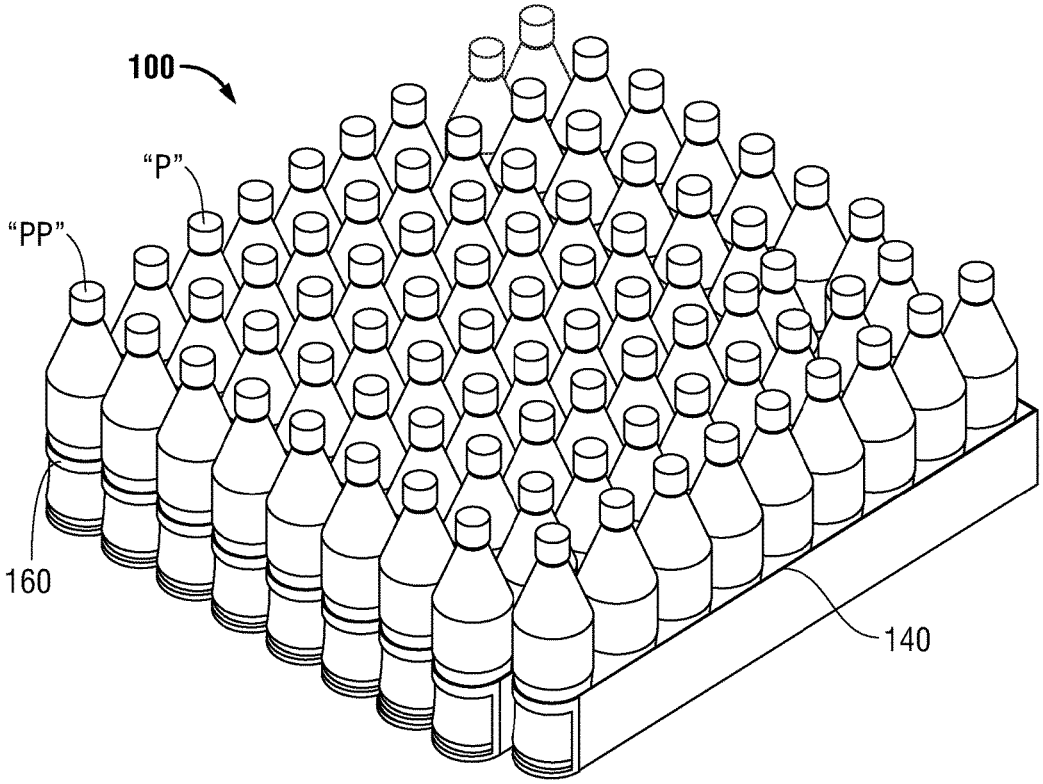
FIG. 6 is a perspective view of the product display unit of FIGS. 5A and 5B including a plurality of products on each track.

A pusher 190 is used to urge products "P" laterally (e.g., perpendicular to the longitudinal axis "A-A") in the general direction of arrow "B" (FIG. 1) along the distal portion 122*b* of the second track 120*b*. It is envisioned that pusher 190 is slidable along the product-supporting surface 130 of the distal portion 122*b* of the second track 120*b*, and that pusher 190 is biased toward the direction of travel (i.e., in the general direction of arrow "B" in FIG. 1; to the right in FIG. 1) by a biasing element 192 (FIG. 2C). It is further envisioned that the pusher 190 is only movable in a single direction (i.e., in the general direction of arrow "B") and thus is only able to move along the distal portion 122*b* of the second track 120*b*.

The second track 120*b* is disposed between a first sidewall 142*b* and a second sidewall 146*b*. First sidewall 142*b* includes a first linear portion 143*b*, a second linear portion 144*b*, and an arcuate portion 145*b* interconnecting the first linear portion 143*b* and the second linear portion 144*b*. Second sidewall 146*b* includes a first linear portion 147*b*, a second linear portion 148*b*, and an arcuate portion 149*b* interconnecting the first linear portion 147*b* and the second linear portion 148*b*. Accordingly, a product "P" on second track 120*b* initially travels perpendicularly to the longitudinal axis "A-A" and then travels parallel to the longitudinal axis "A-A," while a product "P" on first track 120*a* is only capable of travelling in a direction parallel to the longitudinal axis "A-A."

A distal member 180*a* of the first track 120*a* is located adjacent a distal-most portion thereof and is configured to help maintain products "P" on the product-supporting surface 130 of first track 120*a*. Distal member 180*a* is oriented perpendicular to the direction of travel of the products "P" on the first track 120*a*, and is thus perpendicular to the longitudinal axis "A-A."

A distal member 180*b* of the second track 120*b* is located beyond the pusher 190 (i.e., to the left of the pusher 190 in FIGS. 2A and 2B) and is configured to help maintain products "P" on the product-supporting surface 130 of the second track 120*b*. Distal member 180*b* is oriented perpendicular to the distal member 180*a* of the first track 120*a* (i.e., parallel to axis "A-A").

While the accompanying figures illustrate product display unit 100 including certain numbers of first tracks 120*a* and second tracks 120*b*, product display unit 100 may include more or fewer first tracks 120*a* and more or fewer second tracks 120*b*. Further, the orientation and arrangement of first tracks 120*a* and second tracks 120*b* may depart from the illustrated embodiments without departing from the scope of the present disclosure.

In use, product display unit 100 is capable of supporting a larger number of the same size of products on the second track 120*b* with respect to the first track 120*a*. The increased capacity of the second track 120*b* may be useful when a certain product (e.g., a sale item, more popular item, etc.) is shopped more frequently from the product display unit 100. The use of the disclosed product display unit 100 therefore helps ensure a longer amount of time before a particular track (e.g., second track 120*b*) is empty, and helps ensure a longer amount of time necessary to restock the product display unit 100 with more products "P."

The present disclosure also includes a method of displaying products "P." The method includes positioning a first plurality of products "P" in the first row 120*a* such that each product "P" of the first plurality of products is solely movable in a general linear direction along or parallel to the longitudinal axis "A-A." The method also includes positioning a second plurality of products "P" in the second row 120*b* such that at least one product "P" of the second plurality of products is movable in a first direction that is at an angle (e.g., perpendicular) with respect to the longitudinal axis "A-A" and is movable in a second direction that is parallel to the longitudinal axis "A-A."

Further details of related product display units are described in commonly-owned U.S. Pat. No. 5,645,176, which issued on Jul. 8, 1997, the entire contents of which being incorporated by reference herein.

It will be understood that various modifications may be made to the embodiments disclosed herein. Therefore, the above description should not be construed as limiting, but merely as exemplifications of various embodiments. Those skilled in the art will envision other modifications within the scope and spirit of the claims appended hereto.

The invention claimed is:

1. A product display unit, comprising:

a first track defining a longitudinal axis and configured to support a first plurality of products thereon, the first track configured to guide the first plurality of products along the longitudinal axis;

a second track configured to support second plurality of products thereon, a first portion of the second track configured to guide at least one product of the second plurality of products in a first direction that is perpendicular to the longitudinal axis, and a second portion of the second track configured to guide the at least one product of the second plurality of products in a second direction that is parallel to the longitudinal axis;

a distal member disposed on a portion of the first track and disposed at an angle to the longitudinal axis, the distal member configured to prevent at least one product of the second plurality of products on the second track from moving to the first track;

a first sidewall and a second sidewall defining the second track therebetween, wherein the first sidewall includes a first linear portion and a second linear portion, the first linear portion is disposed at an angle with respect to the second linear portion, and wherein the distal member is a part of the second sidewall; and a pusher disposed in mechanical cooperation with the first portion of the second track, the pusher is configured to move along a second axis, the second axis being perpendicular to the longitudinal axis;

wherein the first track is defined between two sidewalls, and wherein the distal member extends between and is in contact with each sidewall of the two sidewalls defining the first track.

2. The product display unit according to claim 1, wherein the first portion of the second track is disposed at a distal portion of the second track.

3. The product display unit according to claim 1, wherein at least part of the first portion of the second track is disposed distally of a distal-most portion of the first track.

4. The product display unit according to claim 1, wherein an entirety of a length of the first track is disposed along the longitudinal axis.

5. The product display unit according to claim 1, wherein the first track is inclined to facilitate gravity feed of at least one product of the first plurality of products positioned thereon.

6. The product display unit according to claim 1, wherein the first linear portion is perpendicular to the second linear portion.

7. The product display unit according to claim 1, wherein the first sidewall includes a first curved section interconnecting the first linear portion and the second linear portion.

8. The product display unit according to claim 7, wherein the second sidewall includes a third linear portion, a fourth linear portion, and a second curved section interconnecting the third linear portion and the fourth linear portion.

9. The product display unit according to claim 1, wherein the first track and the second track are within a single plane.

10. A method of displaying products, comprising:

positioning a first plurality of products on a first track such that each product of the first plurality of products is movable along a longitudinal axis;

positioning a second plurality of products on a second track such that at least one product of the second plurality of products is movable in a first direction that is disposed at an angle to the longitudinal axis and is movable in a second direction that is parallel to the longitudinal axis, wherein the first direction is perpendicular to the second direction;

biasing the at least one product of the second plurality of products in the first direction; and utilizing a distal member disposed on a portion of the first track and disposed at an angle to the longitudinal axis to prevent the at least one product of the second plurality of products from entering the first track, wherein the distal member is a part of a sidewall of the second track and is disposed perpendicular to the longitudinal axis;

wherein the first track is defined between two sidewalls, and wherein the distal member extends between and is in contact with each sidewall of the two sidewalls defining the first track.

11. The method according to claim 10, further comprising moving the at least one product of the second plurality of products in the first direction along a first portion of the second track, and subsequently moving the least one product of the second plurality of products in the second direction along a second portion of the second track.

12. The method according to claim 11, further comprising moving the at least one product of the second plurality of products along an arcuate path after moving the at least one product of the second plurality of products in the first direction along a first portion of the second track, and before moving the least one product of the second plurality of products in the second direction along a second portion of the second track.

13. The product display unit according to claim 1, wherein the distal member is configured to prevent at least one product of the second plurality of products from moving from the first portion of the second track to a distal portion of the first track.

14. The product display unit according to claim 1, wherein the first linear portion is perpendicular to the second linear portion.

* * * * *